United States Patent [19]

Heighton

[11] 3,977,208

[45] Aug. 31, 1976

[54] CONTAINERS FOR PERISHABLE CARGOES

[75] Inventor: Arthur Victor Heighton, Ongar, England

[73] Assignee: Overseas Containers Limited, London, England

[22] Filed: Dec. 10, 1974

[21] Appl. No.: 531,358

[30] Foreign Application Priority Data

Dec. 10, 1973 United Kingdom ..... 57040/73

[52] U.S. Cl. ..... 62/237; 62/240; 62/371; 62/412; 62/419; 98/32

[51] Int. Cl.[2] ..... F25D 15/00; B63B 25/26; F25D 17/06; F24F 13/00

[58] Field of Search ..... 62/237, 298, 336, 337, 62/331, 371, 240, 419, 408, 411, 412; 98/32

[56] References Cited

UNITED STATES PATENTS

| | | | |
|---|---|---|---|
| 1,868,933 | 7/1932 | Veilleux | 62/412 |
| 2,240,377 | 4/1941 | Preble | 62/237 |
| 2,872,792 | 2/1959 | Corhanidis | 62/419 |
| 3,225,822 | 12/1965 | Westling | 62/371 |
| 3,410,337 | 11/1968 | Priest | 62/337 |
| 3,440,834 | 4/1969 | Hirai | 62/240 |
| 3,477,243 | 11/1969 | Schroeder | 62/237 |
| 3,537,379 | 11/1970 | Hirai | 62/237 |
| 3,879,957 | 4/1975 | Wilson | 62/419 |

*Primary Examiner*—Lloyd L. King
*Attorney, Agent, or Firm*—Stewart and Kolasch, Ltd.

[57] ABSTRACT

An uninsulated container for use in insulated holds has an inlet opening at the base of the container for the introduction of cooled air, a plenum chamber for distributing the air from the opening to the interior of the container, and an outlet opening at the top of the container for the return of the air to the hold. A closure member is provided for the inlet opening for use when the container is removed from the hold and this closure member is mounted within the container. The plenum chamber is formed within a transverse frame member at the bottom of one end wall of the container while the outlet opening is in the top of the other end wall.

3 Claims, 3 Drawing Figures

CONTAINERS FOR PERISHABLE CARGOES

Figure 1:
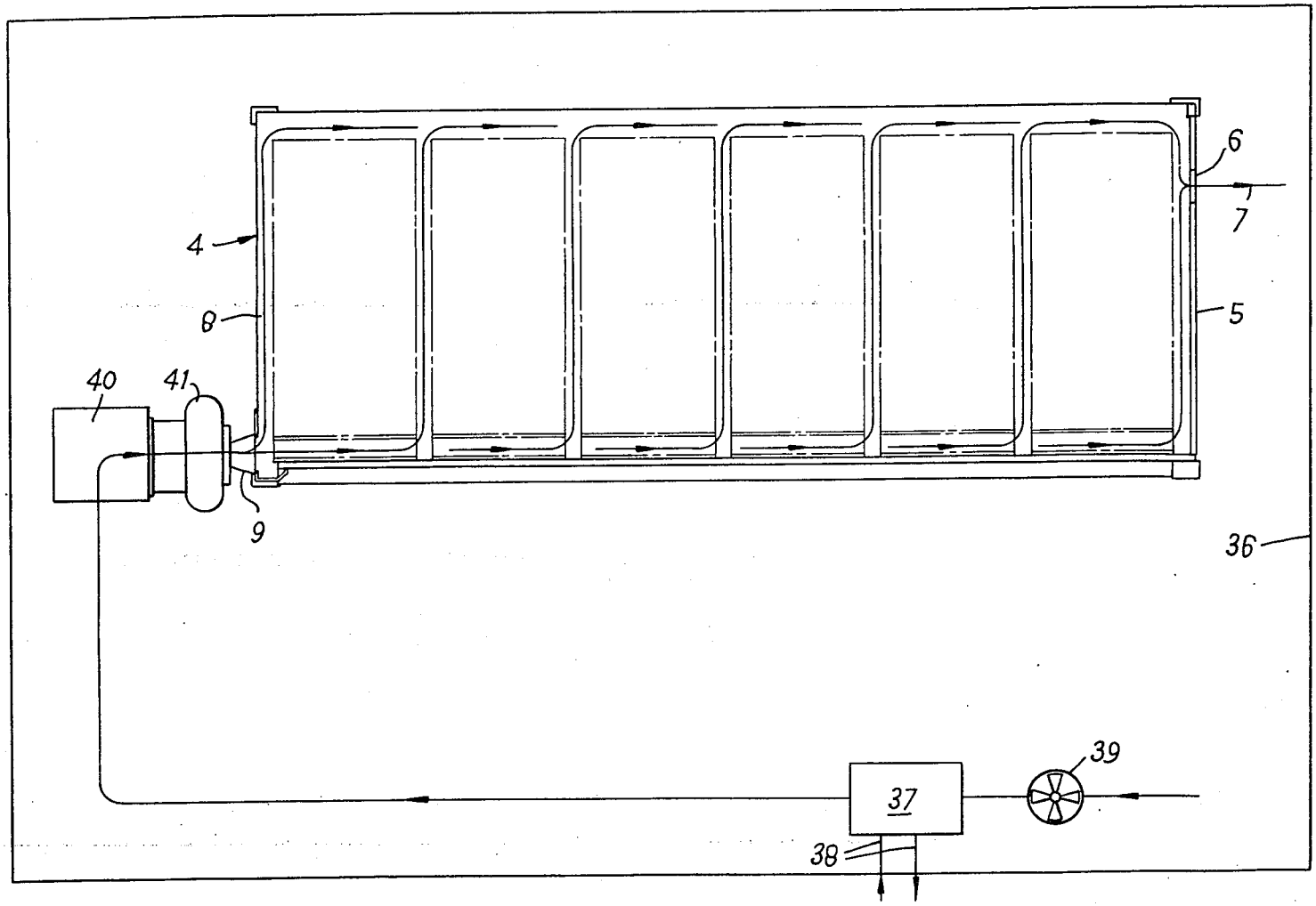

The present invention relates to containers, sometimes known as transcontainers, used for the transport of goods in bulk on ships, road and rail vehicles and other forms of transport. The invention is concerned particularly with containers which can be used for the transport by sea of perishable goods which have to be kept at a low temperature.

It is already known to provide for this purpose thermally-insulated containers which can be refrigerated. It is also known to maintain the required low temperature by circulation of cold air through the container. In the first case the special insulated containers are expensive to construct and to make the expense worth while they must always be used for the same type of load. In the second case a special type of container is required which has the necessary inlet and outlet openings for the circulation of cold air and this again is more expensive to build and is confined to use with vessels equipped with the necessary equipment for supply of cool air. It is an object of the present invention to provide a container which is suitable for use as a general cargo container and is also constructed to allow cool air to be circulated through it when carrying perishable cargo.

In accordance with the invention there is provided a container having at its base a plenum chamber extending across the width of the container with an inlet opening for the admission of cold air from the exterior of the container and a closure member for the inlet opening, the plenum chamber communicating with the interior of the container, and an outlet opening at the top of the container for the discharge of air.

In use with perishable cargo such a container is carried in a refrigerated hold and cold air is fed to the inlet opening through ducting from a cooler by a circulating fan. The cold air passes through the interior of the container and escapes from the outlet opening into the hold space.

Preferably, the plenum chamber is formed at one end of the container, the inlet opening being in an end wall, and the outlet opening is at the other end of the container. The plenum chamber can be formed in part by a channel-section member forming a transverse member of the base frame of the container. The plenum chamber communicates with the interior of the container by way of a gap between the floor of the container and the lining of the end wall. The arrangement is particularly satisfactory when the cargo is carried on pallets which are constructed of spaced parallel bars which in one layer extend in a first direction and in adjacent layers extend in a perpendicular direction. This provides channels for the even distribution of the cold air through the cargo.

The closure member is preferably a cover mounted within the container to be applied against the inlet opening so that as little as possible of the closure mechanism lies on the outside of the container, a securing handle being all that is necessary. In a preferred embodiment the closure cover is a plate carried by arms extending generally perpendicular to the plate and mounted for swinging movement about a common axis parallel to the plane of the plate.

Figure 2:
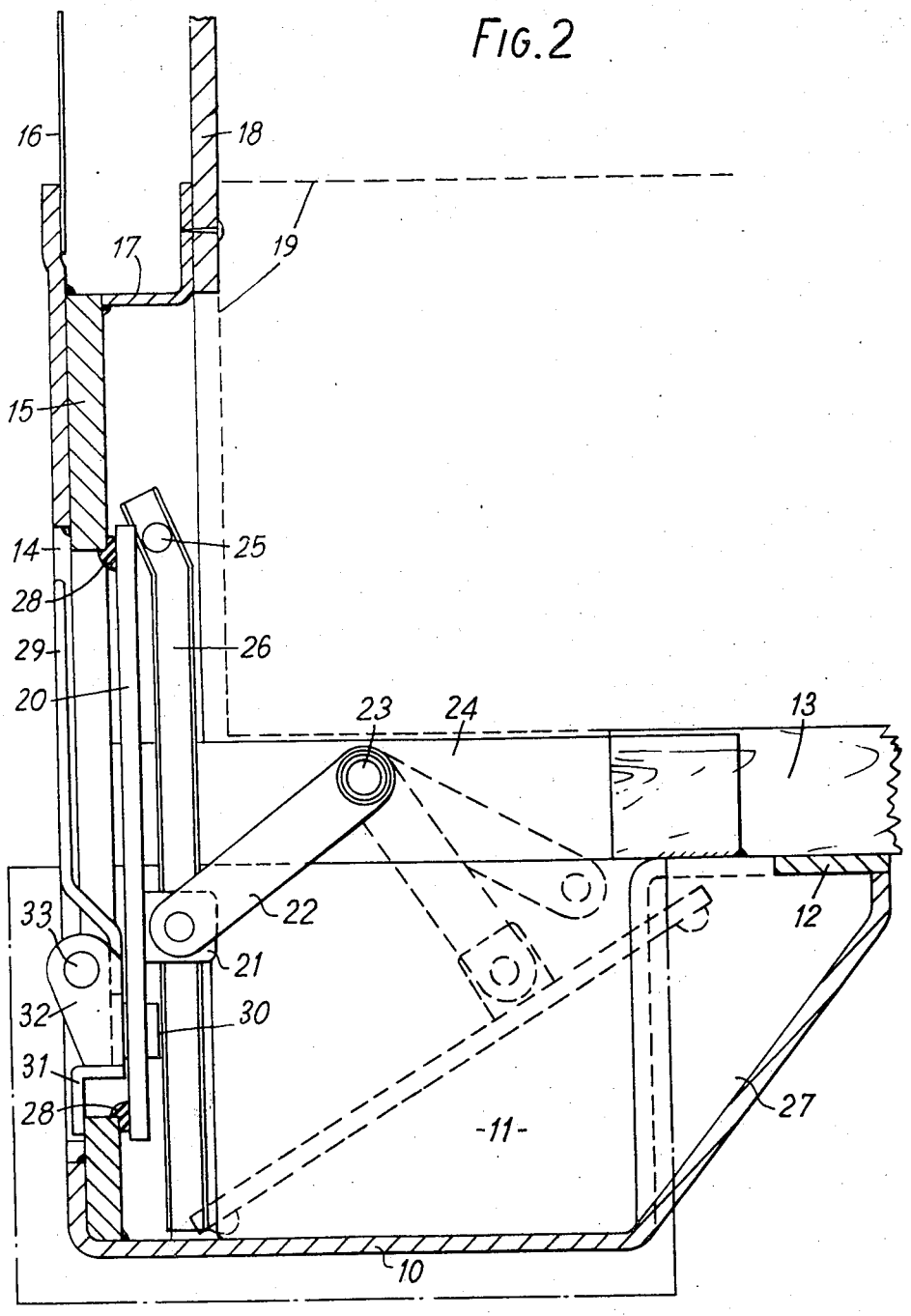
Figure 3:
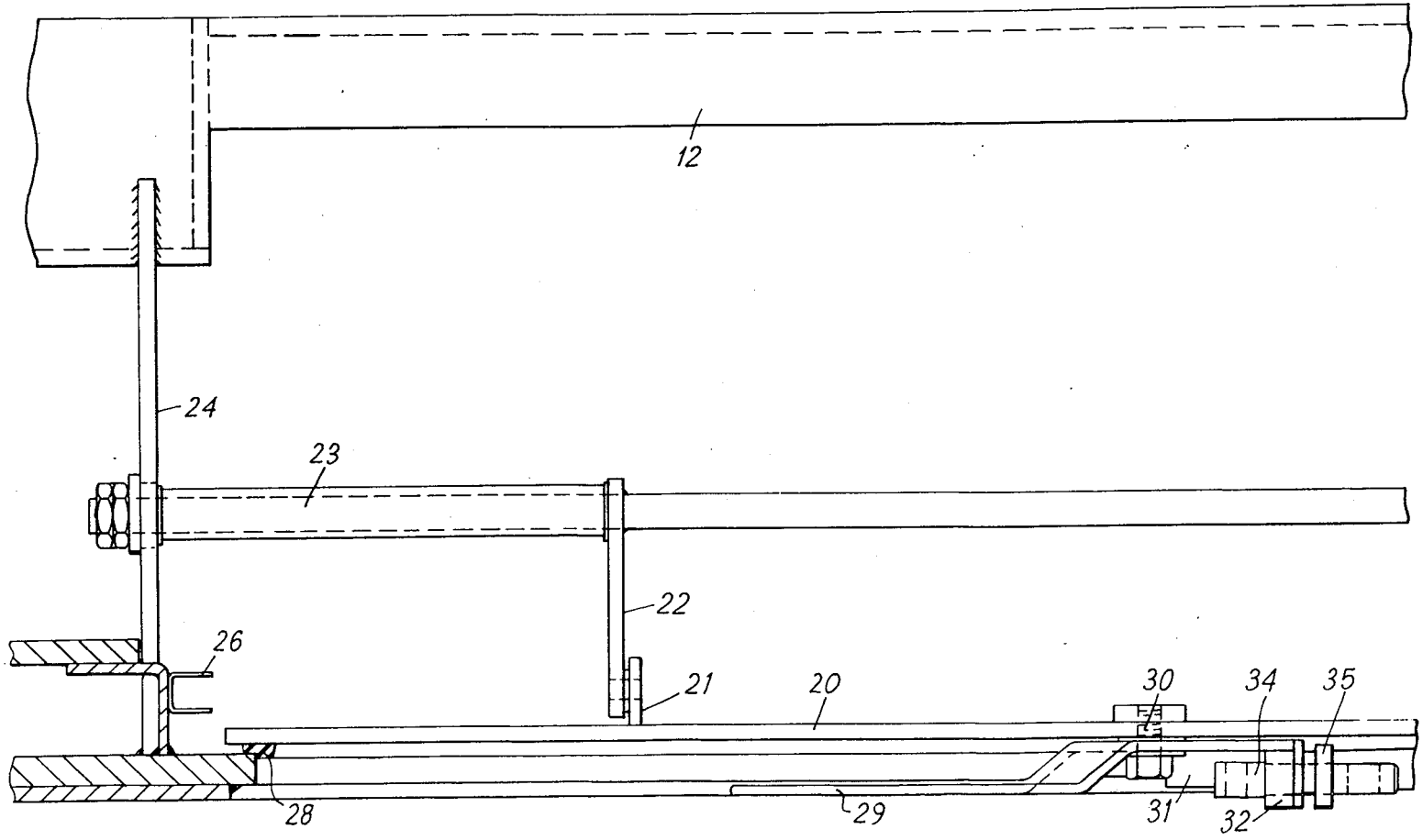

The invention will now be described in more detail with the aid of an example illustrated in the accompanying drawings, in which:

FIG. 1 is a schematic drawing showing a container in accordance with the invention together with equipment for supplying cold air thereto, FIG. 2 is a section, in a vertical plane extending longitudinally of the container, of the lower part of one end of the container of FIG. 1, showing a plenum chamber, an inlet opening, and a closure mechanism for the inlet opening, and FIG. 3 is a partial plan view of the closure mechanism of FIG. 2.

The container in accordance with the invention, shown at 4 in FIG. 1 is for the most part a standard 20 ft. I.S.O. general cargo container with a metal frame, outer walls of sheet metal, a wooden floor, and an inner lining of plywood. At the top of one end wall 5 it is provided with a vent or vents 6 for the escape of air from the inside of the container as shown by the flow line 7. These vents 6 can be covered with grilles to prevent passage of objects. At the bottom of the other end wall 8 of the container 4 cold air is delivered into the container from a nozzle 9 in order to maintain a low temperature within the container when perishable cargo is being carried.

FIG. 2 shows the construction of the container at the bottom of the end wall 8.

The sill which forms part of the frame of the container and extends across the width of the container at the bottom of the end wall differs in form from the conventional sill. It consists of a channel-section member 10 which is open on its upper side and encloses a plenum chamber 11 which extends across the width of the container. On its inner side the sill member 10 has a flange 12 which serves for the support of boards 13 forming the floor of the container. On its outer side the sill member 10 extends upwards above the level of the floor and is formed with a rectangular opening 14 around the periphery of which a reinforcing frame 15 is secured to the inside face of the sill member. In a container of standard dimensions the opening 14 is 2 ft. long and 6 in. high. The outer sheet metal wall 16 of the container is fixed to the upper edge of the outer limb of the sill member 10. An angle strip 17 attached to the frame 15 supports the lower edge of an inner lining 18. Both the inner lining 18 and the floor boards 13 stop short of the edge in which they would normally meet, this allowing free communication between the plenum chamber 11 and the interior of the container. In use the load is placed in the container in pallets, the outline of one of which is indicated by the broken line 19. These pallets are of openwork construction and thus serve to distribute cool air from the plenum chamber 11 across the floor of the container from which it flows upwards through the cargo and is discharged through the vents 6 at the other end of the container.

The opening 14 through which cool air is supplied to the plenum chamber 11 can be shut by means of a cover plate 20 when cool air is not to be circulated through the container. The cover plate 20 has a pair of lugs 21 on its inner frame (only one of which can be seen in the drawings) which are pivotally connected to respective swinging arms 22 secured to a rod 23 which is rotatably mounted in end brackets 24. The upper edge of the plate 20 carries at its ends guide rollers 25 which run in guide rails 26. It will be seen that by reason of the mounting of the plate 20 on the swinging arms 22 and the provision of the guide rails 26 the plate can be moved from the closed position shown in full lines to the open position shown in broken lines in FIG.

2. This movement, which takes place largely under gravity, places the plate 20 within the sill member 10 which has a bay 27 to accommodate the plate 20.

The cover plate 20 has a peripheral seal 28 and is pressed against the frame 15 by the inclined upper end of the guide rail 26 and the action of a latch member 29 which is pivotally attached to the plate 20 by a pivot 30 and has a hook portion 31 engageable with the edge of the frame 15. The latch member 29 also has a lug 32 with an opening 33 in which a locking pin 34 is fixed which passes through a fixed lug 35 and can be secured by a Customs seal.

Returning now to FIG. 1, the container 4 is placed within an insulated cargo hold 36. A cooler unit 37 within the hold is supplied with refrigerant by lines 38. An air intake fan 39 draws air from the hold space and passes it through the cooler unit 37. From here it passes to a header 40 which carries a number of pneumatically-operated connectors 41 (only one of which is shown) each having a nozzle 9 to cover the inlet opening 14 of one of the containers stacked in the hold.

I claim:

1. A container having at its base a plenum chamber extending across the width of the container, an inlet opening for the supply of cold air from the exterior of said container, said inlet opening being disposed in one end wall of the container and said plenum chamber being adjacent said one end wall and connecting said inlet opening with the interior of the container, a closure member for the inlet opening, an outlet opening at the top of the container for the discharge of air, said outlet opening being in the other end wall of the container, and a base frame comprising a transverse end member of channel formation, said plenum chamber being at least in part within said channel-form end member.

2. A container having at its base a plenum chamber extending across the width of the container, an inlet opening for the supply of cold air from the exterior of said container, said plenum chamber connecting said inlet opening with the interior of the container, and a closure member for the inlet opening, said closure member being a cover mounted within the container to be applied against the inlet opening, said cover comprising a plate provided with carrying arms which extend from said plate in a direction generally perpendicular to the plane of the plate, said arms being mounted for swinging movement about a common axis parallel to the plane of the plate.

3. A container having at its base a plenum chamber extending across the width of the container, an inlet opening for the supply of cold air from the exterior of said container, said plenum chamber connecting said inlet opening with the interior of the container, a closure member for the inlet opening, said closure member comprising a cover mounted within the container to be applied against the inlet opening, and a latch member mounted on said cover to be accessible from the exterior of the container when the cover is applied to the inlet opening.

* * * * *